US008251680B2

(12) United States Patent
Fujioka

(10) Patent No.: US 8,251,680 B2
(45) Date of Patent: Aug. 28, 2012

(54) FAN MOTOR ATTACHING STRUCTURE

(75) Inventor: Shintarou Fujioka, Tokyo (JP)

(73) Assignee: NEC Corporation, Minato-Ku, Tokyo (JP)

( * ) Notice: Subject to any disclaimer, the term of this patent is extended or adjusted under 35 U.S.C. 154(b) by 1385 days.

(21) Appl. No.: 11/898,457

(22) Filed: Sep. 12, 2007

(65) Prior Publication Data

US 2008/0063548 A1 Mar. 13, 2008

(30) Foreign Application Priority Data

Sep. 13, 2006 (JP) ..... 2006-248321

(51) Int. Cl.
*F04B 35/04* (2006.01)

(52) U.S. Cl. ..... 417/423.14; 361/697

(58) Field of Classification Search ..... 417/423.1, 417/423.14; 361/695, 697
See application file for complete search history.

(56) References Cited

U.S. PATENT DOCUMENTS 6,075,698 A * 6/2000 Hogan et al. ..... 361/695
6,414,845 B2 * 7/2002 Bonet ..... 361/695

FOREIGN PATENT DOCUMENTS

JP 2000-022375 1/2000
JP 3078515 4/2001

* cited by examiner

*Primary Examiner* — Charles Freay
*Assistant Examiner* — Patrick Hamo
(74) *Attorney, Agent, or Firm* — McGinn IP Law Group, PLLC

(57) ABSTRACT

A fan case and a fan unit realize a fan motor attaching structure in which a fan motor is fixed without a tightening part while the number of functional parts is decreased. The fan case is formed in a box shape having an opening formed by a bottom face, side faces, a front face, and a rear face, and the opening is substantially similar to an outer shape of at least the two fan motors. The front face includes a handle, and the rear face has an opening to expose a connection surface of a connector electrically connected to the fan motor. The side face includes a first latch and a second latch, which are provided so as to be projected toward the opposite side face. A ventilating hole and a bent portion are provided in the bottom face.

15 Claims, 4 Drawing Sheets

FAN MOTOR ATTACHING STRUCTURE

This application is based upon and claims the benefit of priority from Japanese patent application No. 2006-248321, filed on Sep. 13, 2006, the disclosure of which is incorporated herein in its entirety by reference.

BACKGROUND OF THE INVENTION

1. Field of the Invention

The present invention pertains to an attaching structure of a fan motor that cools an electronic component, a fan case therefore, and a fan unit.

2. Description of the Related Art

Recently, as high-density mounting or high-heat-generating mounting of devices of a communication apparatus is performed, it has become necessary to cool an apparatus somehow.

Generally, air is forcedly circulated in the apparatus with a fan motor to cool the apparatus.

In many cases, at least two fan motors are fixed into a common fan case and used as a fan unit. The fan unit forms a structure in which the whole fan unit is detachably attached along with the fan case.

The fan motors are attached to the fan case constituting the fan unit. Usually, in the fan motor fixing method, the fan motor is fixed to the fan case with screws, and adhesive is further applied for screws not to loosen by vibration.

In case of the high-heat-generating mounting, it is necessary to form a chamber function to exploit the fan motor. To form a chamber, a component is attached to the fan motor.

A handle is attached to a front face of the fan unit because the fan unit is detachably attached, and the handle is usually formed as a separate component.

FIG. 1 shows an example of a configuration of a conventional fan unit. The conventional fan unit has the following drawbacks because the fan unit is formed by individual functional parts:

(1) Cost is increased because the number of structure parts (such as a handle 14 and a spacer 15) is increased.

(2) A tightening part (screw 16 or nut) is required to attach the fan motor to the fan case.

(3) Due to the vibration caused by rotation of the fan motor, adhesive is needed for the screw 16 not to loosen. In this case, the number of steps for assembling a unit increases.

Thus, as the number of parts of the conventional fan unit increased, the cost and the steps for producing the fan unit also increased.

Therefore, for example, "a fixing device for a heat dissipation apparatus" disclosed in Japanese Utility Model Registration No. 3078515 and "a fan unit fixing structure" disclosed in Japanese Patent Application Laid-Open No. 2000-022375 are proposed as a technique of fixing a fan motor without tightening parts.

However, in the techniques disclosed in Japanese Utility Model Registration No. 3078515 and Japanese Patent Application Laid-Open No. 2000-022375, the fan motor may be fixed without any tightening part, but there is no suggestion of reducing the number of functional parts such as a handle and a spacer. Therefore, the techniques cannot solve the problem on the increase of the number of structure parts.

Additionally, in the structures of the techniques disclosed in Japanese Utility Model Registration No. 3078515 and Japanese Patent Application Laid-Open No. 2000-022375, although the fan motor is fixed to the fan case, the whole fan unit cannot be detachably attached along with the fan case. Therefore, the whole fan unit including the fan case is not easily detached or attached.

Thus, the conventional technique does not provide a fan motor attaching structure in which a fan motor is fixed to a fan case without tightening parts while the number of functional parts is decreased.

SUMMARY OF THE INVENTION

An exemplary object of the invention is to provide a fan motor attaching structure and a fan case in which a fan motor is fixed to the fan case without tightening parts while the number of functional parts is decreased, and a fan unit having a structure in which the whole fan unit is easily pulled out or put into along with the fan case.

A fan motor attaching structure according to an exemplary aspect of the invention is characterized in that at least two fan motors are fitted in a fan case while integrally retained in the fan case, the fan case being formed in a box shape having an opening formed by a bottom face, side faces, a front face, and a rear face, the side faces being vertically provided at edges of the bottom face, the opening being substantially similar to an outer shape of at least the two fan motors arranged in line in the fan case, a blade being provided in a cylindrical portion of the fan motor, the cylindrical portion including substantially rectangular flanges at both ends thereof, the front face including a grasping portion which constitutes a handle for applying an external force in a longitudinal direction, the rear face having an opening to expose a connection surface of a connector electrically connected to the fan motor, the side face including a first projection and second projection, the first projection being provided so as to be projected toward the opposite side face at a position which is brought close to the cylindrical portion in retaining the fan motor, the second projection being provided so as to be projected toward the opposite side face at a position which is not brought close to the cylindrical portion but located between the flanges in retaining the fan motor, a ventilating hole and a space retaining member being provided in the bottom face, the ventilating hole constituting a passage of cooling flow generated by the fan motor, the space retaining member keeping at least a predetermined space between the bottom face and the fan motor.

A fan case according to an exemplary aspect of the invention integrally retains at least two fan motors while the fan motors are arranged in line, a blade of the fan motor being provided in a cylindrical portion including substantially rectangular flanges at both ends, wherein the fan case is formed in a box shape having an opening formed by a bottom face, side faces, a front face, and a rear face, the side faces being vertically provided at edges of the bottom face, the opening being substantially similar to an outer shape of at least the two fan motors, the front face includes a grasping portion which constitutes a handle for applying an external force in a longitudinal direction, the rear face has an opening to expose a connection surface of a connector electrically connected to the fan motor, the side face includes a first projection and second projection, the first projection being provided so as to be projected toward the opposite side face at a position which is brought close to the cylindrical portion in retaining the fan motor, the second projection being provided so as to be projected toward the opposite side face at a position which is not brought close to the cylindrical portion but located between the flanges in retaining the fan motor, and a ventilating hole and a space retaining member are provided in the bottom face, the ventilating hole constituting a passage of cooling flow generated by the fan motor, the space retaining member keeping at least a predetermined space between the bottom face and the fan motor.

A fan unit according to an exemplary aspect of the invention includes a fan case which integrally retains at least two fan motors while the fan motors are arranged in line, a blade of the fan motor being provided in a cylindrical portion including substantially rectangular flanges at both ends, wherein the fan case is formed in a box shape having an opening formed by a bottom face, side faces, a front face, and a rear face, the side faces being vertically provided at edges of the bottom face, the opening being substantially similar to an outer shape of at least the two fan motors, the front face includes a grasping portion which constitutes a handle for applying an external force in a longitudinal direction, the rear face has an opening to expose a connection surface of a connector electrically connected to the fan motor, the side face includes a first projection and second projection, the first projection being provided so as to be projected toward the opposite side face at a position which is brought close to the cylindrical portion in retaining the fan motor, the second projection being provided so as to be projected toward the opposite side face at a position which is not brought close to the cylindrical portion but located between the flanges in retaining the fan motor, a ventilating hole and a space retaining member are provided in the bottom face, the ventilating hole constituting a passage of cooling flow generated by the fan motor, the space retaining member keeping at least a predetermined space between the bottom face and the fan motor, and the fan motor retained by the fan case is positioned in a crosswise direction by biasing the first projection, and the fan motor is positioned in a longitudinal direction by cramping the flange between the second projection and the space retaining member.

BRIEF DESCRIPTION OF THE DRAWINGS

Features of the disclosed embodiments will be described by way of the following detailed description with reference to the accompanying drawings in which.

DESCRIPTION OF EXEMPLARY EMBODIMENTS

Figure 1:
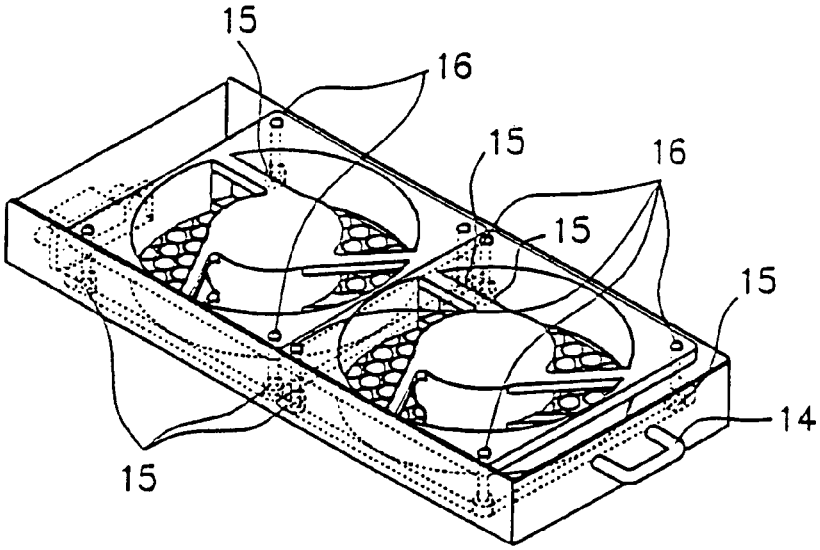
RELATED ART FIG. 1
FIG. 1 is a view showing a configuration of a conventional fan unit.
Figure 2:
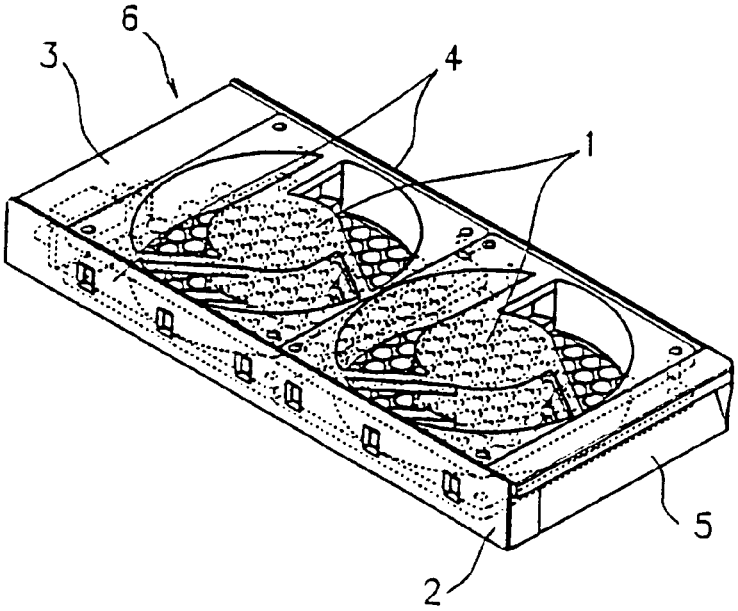
FIG. 2 is a view showing a configuration of a fan unit according to a preferred embodiment of the invention.
Figure 3:
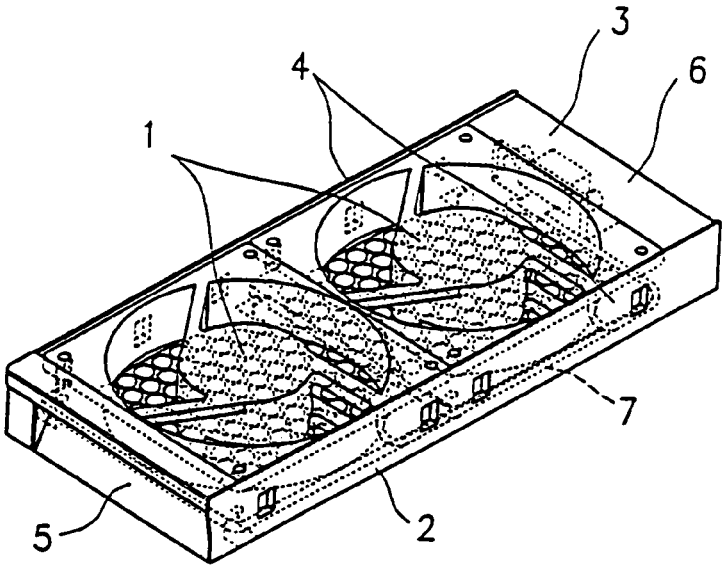
FIG. 3 is a view showing a configuration of a fan unit according to a preferred embodiment of the invention.
Figure 4:
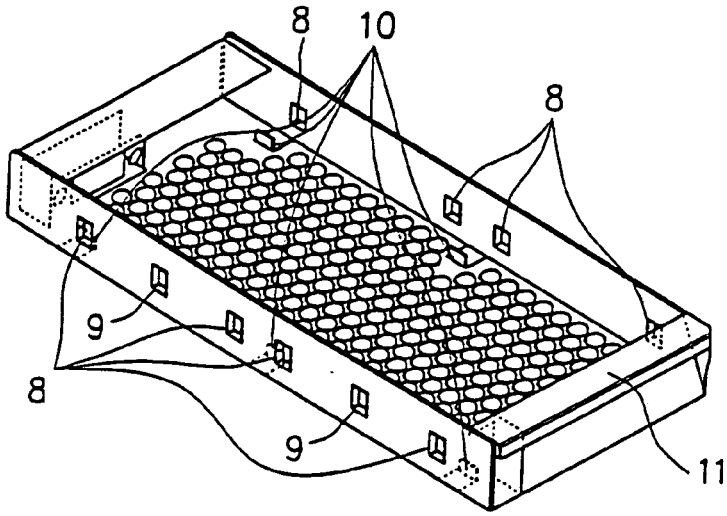
FIG. 4 is a view showing a configuration of a fan case.
Figure 5:
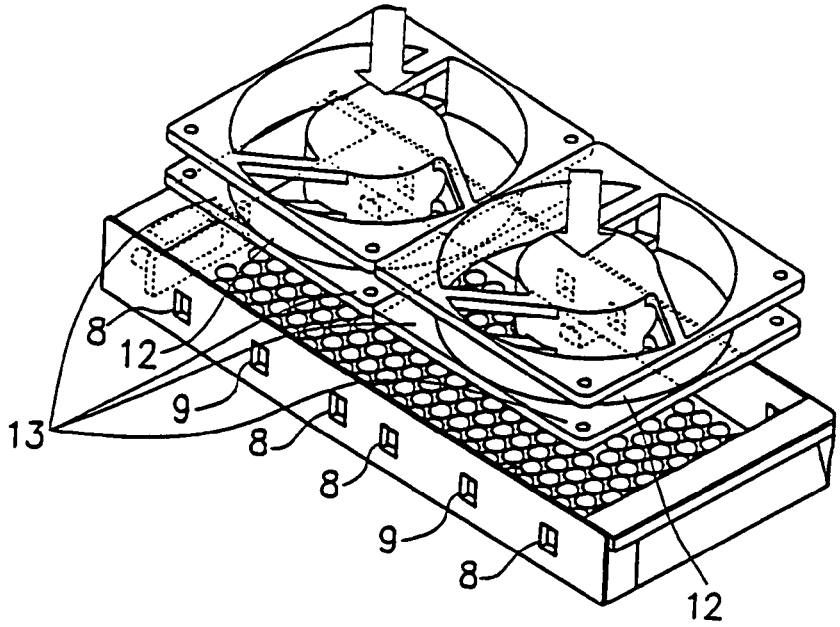
FIG. 5 is a view showing a method of attaching a fan motor to the fan case.

Exemplary embodiments of the invention will be described below with reference to the drawings. FIGS. 2 and 3 show a configuration of a fan unit. FIG. 4 shows a configuration of a fan case. FIG. 5 shows a method of attaching a fan motor to a fan case.

The fan unit of FIGS. 2 and 3 includes a fan motor 1, a fan case 2, and a connector 3.

As shown in FIG. 5, the fan motor 1 has a structure in which blades (fans) are disposed in a cylindrical portion 12 that includes substantially square flanges 13 on both bides. A length of one side of the flange 13 is substantially equal to an outer diameter of the cylindrical portion 12.

The fan case 2 comprises, as shown in FIG. 4, side faces 4, a front face 5, and a rear face 6 that are formed by bending a substantially cross-shaped metal plate. The front face 5 is bent to be a substantial Z-shape when viewed from the side face, which provides a handle 11 for operating the fan unit. The rear face 6 is bent twice, which provides a space between a rear end of the front face 5 and a front end of the rear face 6 to a predetermined length (equal to two fan motors). A box shape formed by the side faces 4, the front face 5, the rear face 6, and a bottom face has a size substantially equal to (or slightly larger than) the outer shape of the two fan motors 1 so as to accommodate the fan motors 1. Latches 8 and 9 are provided in the side faces 4 of the fan case 2, and bent portions 10 are provided in the bottom face. The latches 8 and 9 have tongue shape in which the bottom face side is set to the front end, and the front end sides of the latches 8 and 9 protrude and are inclined inside the fan case 2 and have spring properties. Many holes are made in the bottom face of the fan case 2 by punching. The size of hole need not be specified but preferably, is a size such that a finger does not go through.

Any know connector is applied as the connector 3, and a floating connector is preferably used as the connector 3.

As shown in FIG. 5, a cable 7 outgoing from the fan motor 1 is routed at a proper position, and the fan motor 1 is fitted from above the fan case 2. At this point, as shown in FIG. 3, preferably the cable 7 is routed between the bent portion 10 and the side face 4, because the cable 7 is firmly fixed and does not interrupt airflow.

The latches 8 and 9 in the side face 4 of the fan case 2 are bent and tapered so as to guide the fan motor 1, and the latches 8 and 9 have spring-like properties. Therefore, the fan motor 1 is smoothly attached to the fan case 2.

Figure 6:
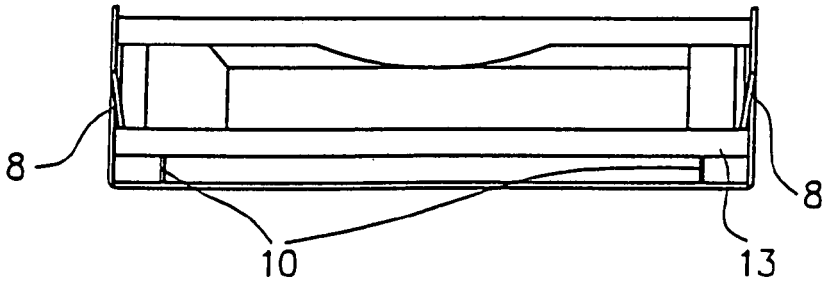
FIG. 6 is a sectional view showing the fan unit after the fan motor is attached.

FIG. 6 shows a sectional view showing the fan unit after the fan motor 1 is attached. The fan motor 1 has the structure in which the flange 13 is cramped by the latch 8 in the side face 4 of the fan case 2 and the bent portion 10 of the bottom face of the fan case 2 so as not to disengage upward or downward from the fan case 2.

Figure 7:
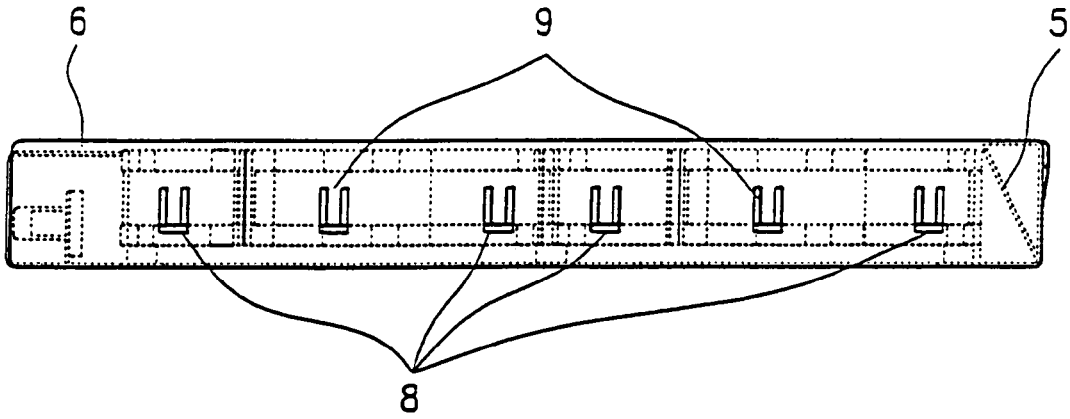
FIG. 7 is a view showing a side face of the fan unit after the fan motor is attached.

FIG. 7 shows a side face of the fan unit after the fan motor 1 is attached. The space between the front face 5 and rear face 6 of the fan case 2 is substantially equal to the two fan motors 1, so that rattling is suppressed in a forward or backward direction of the fan motor 1. The latch 9 presses the side face of the cylindrical portion 12 of the fan motor 1, which suppresses the sway of the fan motor 1.

The fan unit of the embodiment has the structure in which the fan motor 1 is fitted in the fan case 2 from above in attaching the fan motor 1 to the fan case 2. Therefore, the fan motor 1 is firmly attached to the fan case without screws for fixing the fan motor 1, and the easiness of assembly is remarkably improved.

The bent portion 10 in the bottom face acts as a chamber which causes the fan motor 1 to float from the bottom face of the fan case 2 (keeping a space between the fan motor 1 and the bottom face of the fan case 2) and the fan unit operation handle 11 is provided in the front face bent portion, which obtains the following effects:

(a) Reduction of the Number of Structure Parts

The necessary structure parts (chamber function and handle function) are realized by one part because the shape of the fan case, which is necessary to from a fan unit, is specially designed.

(b) Increase in Airflow and Quiet of Fan Motor

The chamber function is integrated into the fan case and the fan motor is kept away from the bottom face of the fan case, so that the increase in airflow and the decrease in wind noise are realized at low cost.

(c) Decrease of the Number of Tightening Parts Used to Fix Parts

Although conventionally tightening parts (screw or nut) are needed to attach the fan motor, the fan unit of the present embodiment does not require screws.

(d) Decrease in Assembly Steps

The structure requiring no screws eliminates a step of screw tightening and adhesive application in the fan unit assembling process.

Therefore, the fan unit is formed at lower cost.

In the fan unit having the above structure, the connector 3 is connected and disconnected to another connector when the handle 11 is grasped and the whole fan unit is moved forward or backward. Therefore, the whole fan unit is easily detachably attached.

Thus, the structure for fixing the fan motor, the chamber structure, and the structure of the fan unit operation portion are integrally formed in the fan case, which reduces the number of structure parts and also costs for the apparatus.

The integration of the parts realizes the decrease of the number of tightening parts necessary to attach the structure parts, simplification of the production process, and the decrease in man hour or steps of the process.

The above embodiment is only an exemplary embodiment, and the invention is not limited to the above embodiment.

For example, though the fan case 2 was formed by bending, the fan case 2 may be made of resin using a metal mold.

In the embodiment, the two fan motors were integrally retained by the fan case but more than two fan motors may be integrally retained while disposed in line.

The fan motor attaching structure according to a second exemplary embodiment may further have a feature that the first projection has a tongue shape in which the bottom face side is set to a front end, and the second projection has a tongue shape in which the bottom face side is set to a front end.

The fan motor attaching structure according to a third exemplary embodiment may further have a feature that the fan case is formed by bending a substantially cross-shaped metal plate. The grasping portion may be formed by bending the front face in a substantial Z-shape. The space retaining member may be formed by providing a notch in the bottom face and bending the bottom face.

The fan case according to a fourth exemplary embodiment may further have a feature that the first projection has a tongue shape in which the bottom face side is set to a front end. The second projection may have a tongue shape in which the bottom face side is set to a front end.

The fan case according to a fifth exemplary embodiment may further have a feature that the fan case is formed by bending a substantially cross-shaped metal plate. The grasping portion may be formed by bending the front face in a substantial Z-shape. The space retaining member may be formed by providing a notch in the bottom face and bending the bottom face.

The fan unit according to a sixth exemplary embodiment may further have a feature that the first projection has a tongue shape in which the bottom face side is set to a front end. The second projection may have a tongue shape in which the bottom face side is set to a front end.

The fan unit according to a seventh exemplary embodiment may have a feature that the fan case is formed by bending a substantially cross-shaped metal plate. The grasping portion may be formed by bending the front face in a substantial Z-shape. The space retaining member may be formed by providing a notch in the bottom face and bending the bottom face.

The fan unit according to an eighth exemplary embodiment may further have a feature that a wiring cable connecting the fan motor and the connector is routed though a gap between the side face and the space retaining member.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A fan case, comprising:

a bottom face where a plurality of ventilating holes is formed;

a rear face comprising an opening to expose a connection surface of a connector;

a front face being opposed to the rear face; and two opposing side faces where a plurality of projections, arranged to project toward an opposite side face, is formed respectively;

wherein the rear face, the front face, and the side faces are vertically provided at edges of the bottom face, and wherein the front face has a Z-shape and comprises a first face being connected with an edge of the bottom face and forming an acute angle with the bottom face, a second face expanding from an edge of the first face in a direction of the front side, and a third face expanding from an edge of the second face in a direction toward the bottom face.

2. The fan case according to claim 1, wherein the projections comprise an elastic body being movable in a direction of the side faces.

3. The fan case according to claim 1, wherein the bottom face, the rear face, the front face, and the side faces are formed by bending a substantially cross-shaped metal plate.

4. The fan case according to claim 1, wherein the bottom face comprises a plurality of space retaining members formed by cutting and folding up a part of the bottom face.

5. A fan unit, comprising:

a fan case of claim 1; and a fan motor arranged in the fan case;

wherein the projections comprise an elastic body being movable in a direction of the side faces, and wherein the fan motor is positioned by being placed between a plurality of latches.

6. The fan unit according to claim 5, wherein the fan motor comprises two rectangular flanges, a cylindrical portion arranged between the flanges, and a blade arranged in the cylindrical portion, and wherein the projections comprise first projections to position the cylindrical portion and second projections to position the rectangular flanges.

7. The fan unit according to claim 5, wherein the fan motor comprises a plurality of flanges and a cylindrical portion arranged between the flanges, and wherein the projections comprise first projections to position the cylindrical portion and second projections to position the flanges.

8. The fan case according to claim 7, further comprising:

bent portions provided in the bottom face, said bent portions comprising a projection that protrudes from the bottom face, wherein the protrusions in the side faces of the fan case and the bent portion of the bottom face cramp the flanges to avoid upward or downward movements of the flanges in the fan case.

9. The fan case according to claim 5, further comprising:

bent portions provided in the bottom face, said bent portions comprising a projection that protrudes from the bottom face, the bent portions providing a chamber which causes the fan motor to float from the bottom face of the fan case by keeping a space between the fan motor and the bottom face of the fan case.

10. The fan case according to claim 5, further comprising:

bent portions provided in the bottom face, said bent portions comprising a projection that protrudes from the bottom face, wherein a cable of the fan motor is routed between the bent portions and one of the side faces.

11. The fan case according to claim 1, wherein the third face of the front face provides holding for an axial movement of the fan case.

12. The fan case according to claim 1, wherein the connector is connected and disconnected to another connector when the third face of the front face is grasped and the fan unit is moved forward or backward.

13. The fan case according to claim 1, wherein the rear face is bent twice to provide a space, with a predetermined length, between a rear end of the front face and a front end of the rear face.

14. The fan case according to claim 1, wherein end sides of the protrusions protrude and are inclined inside the fan case, the protrusions comprising an elastic body.

15. The fan case according to claim 1, further comprising:

bent portions provided in the bottom face, said bent portions comprising a projection that protrudes from the bottom face in a predetermined distance from the side faces.

* * * * *